United States Patent [19]

Riggs et al.

[11] Patent Number: 4,602,476

[45] Date of Patent: Jul. 29, 1986

[54] PLASTIC FILLED WIRE ROPE WITH STRAND SPACER

[75] Inventors: Peter P. Riggs, Ballaugh Glen, United Kingdom; Harry L. Data, Kenosha, Wis.

[73] Assignee: AMSTED Industries Incorporated, Chicago, Ill.

[21] Appl. No.: 677,869

[22] Filed: Dec. 3, 1984

[51] Int. Cl.[4] ..... D07B 1/14; D07B 1/16

[52] U.S. Cl. ..... 57/214; 57/217; 57/221

[58] Field of Search ..... 57/214, 217, 221, 223, 57/232, 241, 248, 7, 200, 210, 215

[56] References Cited

U.S. PATENT DOCUMENTS

| | | | |
|---|---|---|---|
| 2,241,955 | 5/1941 | Noyer et al. | 57/214 |
| 3,018,607 | 1/1962 | Dietz et al. | 57/214 |
| 3,154,910 | 11/1964 | Dietz | 57/214 |
| 4,534,162 | 8/1985 | Riggs et al. | 57/217 |

*Primary Examiner*—Donald Watkins

*Attorney, Agent, or Firm*—Charles E. Bouton; Edward J. Brosius

[57] ABSTRACT

A wire rope is provided having a central core strand about which are wound outer strands. Non-linear spacer wires are present in the gaps between outer strands to assure the uniformity of such gaps and provide passageways from the interior to the exterior of the wire rope. A coating, usually of a suitable thermoplastic, is extruded into such rope to extend continuously from the core and between adjacent outer strands and through the passageways.

5 Claims, 4 Drawing Figures

PLASTIC FILLED WIRE ROPE WITH STRAND SPACER

BACKGROUND OF THE INVENTION

The present invention relates to wire rope and, more particularly, to plastic filled wire rope having spacer means between adjacent outer strands.

Plastic filled or encapsulated wire rope, such as disclosed in U.S. Pat. No. 3,824,777, has been demonstrated to have properties such as tensile strength, fatigue life and corrosion resistance superior to those of equal size bare wire rope. Such improved properties are derived from the separation of the core strand from the outer strands and the outer strands from each other by the thermoplastic material. Suitable thermoplastics include polypropylene, polyurethane, polyethylene, nylon, tetrafluroethylene or polyvinylchloride. Also useful are elastomers such as butyl or nitrile rubber. Such a coating reduces or eliminates such core to strand and strand to strand contact and abrasion when the rope is in service. Further, the coating traps any desired lubricant such as petrolatum, vegetable oils, asphaltic based materials and the like within the strands and resists the ingress of abrasive or corrosive elements into the rope.

However, it is desirable to achieve strand gap or interstice balance in the manufacture of such plastic encapsulated wire rope. Such gap balance insures the equal load sharing by the strands of the rope and also assures the spacing between strands is filled with plastic. One method of such gap control during rope manufacture is set forth in U.S. Pat. No. 3,824,777, wherein a strand gap controller die is utilized to equally separate rope strands during the injection of the plastic.

Another spacing control method is disclosed in U.K. Patent Application No. 2,090,305 A, wherein a preformed filler element of thermoplastic containing a linear reinforcing core is placed independently in the interstice. However, the presence of such independent thermoplastic element impedes or prohibits the introduction of a flowable thermoplastic into the wire rope.

Furthermore, in the course of use of plastic filled wire rope, there is a tendency for the outer portions of plastic at the exterior of the rope to separate from the inner portions of plastic near the core.

Therefore, it is an object of the present invention to provide an encapsulated wire rope having uniform strand gaps.

It is another object of the present invention to provide a plastic filled wire rope with reinforcements connecting inner and outer portions of the plastic fill.

SUMMARY OF THE INVENTION

The present invention relates to a wire rope having uniform strand separation and interstices and to a plastic filled wire rope with reinforcements in the plastic fill.

The rope is comprised of a central core usually comprising strands forming an independent wire rope core (IWRC). Such rope core is surrounded by a plurality of outer strands, each comprised of a plurality of individual wires. As such outer strands are wound around the core, there are gaps or spaces or interstices between such outer strands and the core. As the diameters of the core strand and the outer strands are normally within 25% of each other, those gaps are small. However, it is important for the wear life and other similar properties of the rope that such gaps are as uniform as possible. It is also important that the outer strands be positioned evenly about the periphery of the core strand and that there be substantially uniform spacing between adjacent outer strands. This insures that during the extrusion of the coating material into and within the rope that such coating is uniformly distributed between the core strand and the outer strands and between adjacent outer strands. Accordingly, a spacer means is placed between outer strands during assembly of the rope such as during the closing or rope forming operation. Such spacer means may take different forms, but the function of such spacer means is to insure the uniform gap formation between the outer strands while simultaneously providing a passageway for plastic infill material between the core strand and outer periphery of the outer strands. In a preferred form, the spacer means is comprised of a non-linear steel wire extending longitudinally between adjacent outer wire rope strands and weaving between inner and outer portions of the coating.

The spacer wire may take any one of several configurations. A single wire may be corrugated in a saw tooth or in an arcuate form and may be in the form of a curved or squared sine-wave. It is preferred that the corrugations lie substantially in a single plane so that the wire may be readily laid between outer rope strands.

In particular, the present invention provides a wire rope comprising a central core including a plurality of wire strands, a plurality of outer strands surrounding said core, a plurality of longitudinal non-linear spacer means located in the interstices between outer strands, and a coating extending continuously from substantially the outer diameter of the outer strands down to and into the central core.

With a rope, according to the invention, it is possible to maintain a series of strand to strand gaps of even dimension which permits the ingress of plastic between the strands through passageways held open by the spacer means into the core. The equal strand gaps and the spacer means permit a continuous coating of plastic to be formed to provide both a plastic continuum and a reinforcement running between the inner and outer portions of the plastic infilling, thereby preventing the detachment of the external infilling under arduous operating conditions during periods of continual flexing around sheaves or drums.

DESCRIPTION OF THE PREFERRED EMBODIMENT

Figure 1:
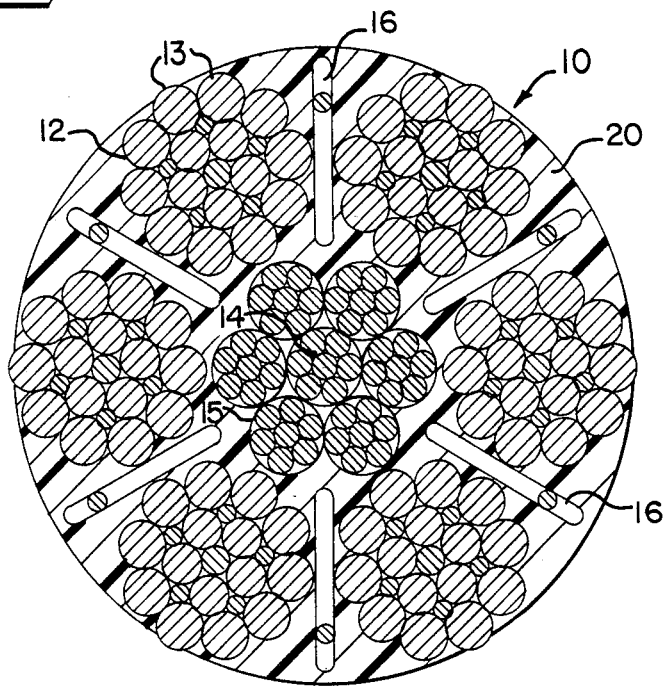
FIG. 1 is a cross section view of plastic filled wire rope incorporating a non-linear spacer wire in accordance with the present invention.
Figure 2:
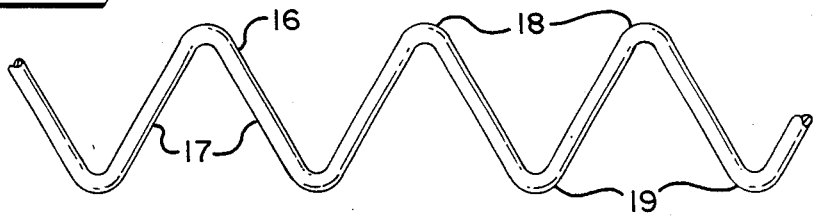
FIG. 2 is a side elevation view of a preferred spacer wire in accordance with the present invention.

Referring now to FIG. 1 of the drawings, a wire rope in cross section is shown generally at 10. A central core strand 14 comprises several single wires 15 in a wire rope configuration. Core 14 is surrounded by a plurality of outer strands 12, each of which is comprised of several single wires 13 in a wire rope configuration. Spacer wires 16 are present in the spaces between each of the outer strands 12. As seen in FIG. 2, spacer wires 16 are non-linear and corrugated like saw teeth so as to repeatedly pass inwardly and outwardly with respect to core 14 so as to position wire segments 17 crosswise to the outer strands 12, whereby to hold adjacent outer strands 12 spaced apart by at least the diameter of wire 16, and position peaks 18 and valleys 19 of the wire 16 spaced from and near, respectively, the core strand 14. The segments 17 are dimensioned to extend the peaks 18 outward of the midpoints of outer strands 12 but not to the outer periphery thereof. In this way, there are a plurality of passageways provided between successive wire segments 17 and between adjacent outer strands 12 beneath every peak 18 and above every valley 19 of each spacer wire 16. The passageways provide communication between the spaces or interstices formed by core 14 and outer strands 12 and the outer grooves between adjacent outer strands.

A coating 20 extends from the outer surface of core 14 into the outer grooves and often to the outer diameter limits of outer strands 12. Coating 20 usually comprises a thermoplastic, and separates core strand 14 from outer strands 12, as well as each outer strands 12 from adjacent outer strands. Coating 20 is uniform and, due to its extruded introduction into rope 10, forms a continuous single element composition which extends uninterrupted through the aforedescribed passageways.

Figure 3:
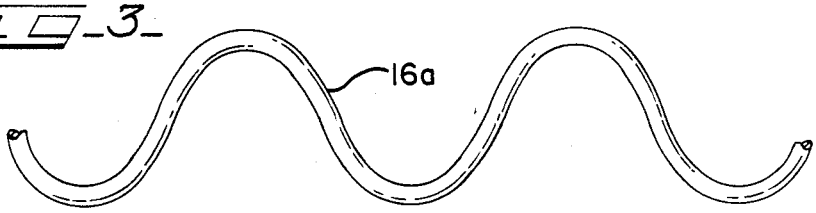
FIG. 3 is a side elevation view of another embodiment of a spacer wire similar to FIG. 2.
Figure 4:
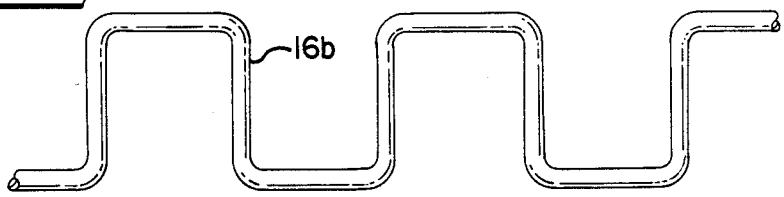
FIG. 4 is a side elevation view of still another embodiment of a spacer wire similar to FIG. 2.

Referring to FIGS. 3 and 4 of the drawings, further embodiments of spacer wire **16*a* and 16*b* are shown in the form of rounded and squared sine-wave form, respectively. A further advantage of each of the illustrated forms of the spacer means is that the wire 16, 16*a* or 16*b* acts as a continuous reinforcement for the plastic coating 12** holding the inner and outer portions thereof together.

Modifications and variations may be made in the aforedescribed invention without departing from the scope thereof which is defined hereafter in the claims.

What is claimed is:

1. A wire rope comprising:

a central core strands, a plurality of outer strands surrounding said core strand, a coating extending substantially continuously from about an outer portion of the outer strands between said outer strands and to an inner portion adjacent the central core strand;

and a plurality of single non-linear spacer wires each being shaped in a corrugated configuration and each located substantially longitudinally between adjacent outer strands and running between said inner portion and said outer portion.

2. A wire rope comprising:

a central core strand, a plurality of outer strands surrounding said core strand, a coating extending substantially continuously from about an outer portion of the outer strands between said outer strands and to an inner portion adjacent the central core strand;

and a plurality of non-linear wires located substantially longitudinally between adjacent outer strands and running between said inner portion and said outer portion wherein each non-linear wire has segments spaced between adjacent outer strands and peaks and valleys between said segments outward and inward of said outer strands whereby to provide multiple passageways for said coating to extend between said outer strands.

3. The wire rope of claim 2, wherein the non-linear wire is in the shape of saw teeth.

4. The wire rope of claim 2, wherein the non-linear wire is in the shape of a rounded sine-wave.

5. The wire rope of claim 2, wherein the non-linear wire is in the shape of a squared sine-wave.

* * * * *